US007522131B2

(12) United States Patent
Kang

(10) Patent No.: US 7,522,131 B2
(45) Date of Patent: Apr. 21, 2009

(54) ELECTRON EMISSION DISPLAY (EED) DEVICE WITH VARIABLE EXPRESSION RANGE OF GRAY LEVEL

(75) Inventor: Mun-Seok Kang, Suwon-si (KR)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 571 days.

(21) Appl. No.: 11/110,897

(22) Filed: Apr. 21, 2005

(65) Prior Publication Data

US 2005/0243029 A1 Nov. 3, 2005

(30) Foreign Application Priority Data

Apr. 29, 2004 (KR) ..... 10-2004-0030006

(51) Int. Cl.
*G09G 3/20* (2006.01)

(52) U.S. Cl. ..... 345/74.1; 345/75.2; 345/75.1

(58) Field of Classification Search ..... 345/204–211, 345/74.1, 98, 55, 75.1, 87–89, 75.2, 76–83, 345/690–693; 313/495; 348/536, 505–507, 348/636–639, 555, 194, E9.029
See application file for complete search history.

(56) References Cited

U.S. PATENT DOCUMENTS 4,860,089 A * 8/1989 Smith ..... 348/194
5,396,584 A * 3/1995 Lee et al. ..... 345/589
5,600,761 A * 2/1997 Ng et al. ..... 345/418
5,742,263 A * 4/1998 Wang et al. ..... 345/8
5,956,004 A * 9/1999 Hush et al. ..... 345/74.1
6,091,382 A * 7/2000 Shioya et al. ..... 345/76
6,140,985 A * 10/2000 Kanai et al. ..... 345/74.1
6,300,922 B1 10/2001 Teggatz
6,317,161 B1 * 11/2001 Renner et al. ..... 348/536

(Continued)

FOREIGN PATENT DOCUMENTS

CN 1321043 11/2001

(Continued)

OTHER PUBLICATIONS

Chinese Office Action corresponding to Patent Application No. 200510067794.4, issued on Dec. 14, 2007(with English translation).

(Continued)

*Primary Examiner*—Prabodh Dharia
(74) *Attorney, Agent, or Firm*—Robert E. Bushnell, Esq.

(57) ABSTRACT

An Electron Emission Display (EED) device, adapted to of adjust a pulse width of data signal according to an active pulse width of a horizontal synchronization signal, includes: a scan driver, a data driver; an EED panel displaying display data; a reference signal memory adapted to store a lookup table of active pulse widths of horizontal synchronization signals defined by a system clock and reference signals corresponding to the active pulse widths of the horizontal synchronization signals; a reference signal referring unit adapted to output a reference signal in accordance with the lookup table stored in the reference signal memory; and a gray level signal generator adapted to count the reference signal and output a gray level signal to the data driver, the data driver outputting video data corresponding to the gray level signal to data electrode lines of the EED panel.

14 Claims, 9 Drawing Sheets

U.S. PATENT DOCUMENTS

| | | | | |
|---|---|---|---|---|
| 6,339,414 | B1 * | 1/2002 | Todokoro et al. | 345/75.1 |
| 6,429,836 | B1 * | 8/2002 | Hansen | 345/74.1 |
| 6,473,061 | B1 * | 10/2002 | Lim et al. | 345/60 |
| 6,567,062 | B1 * | 5/2003 | Kudo et al. | 345/92 |
| 6,756,956 | B2 * | 6/2004 | Kudo et al. | 345/89 |
| 6,803,715 | B1 * | 10/2004 | Mitsutake et al. | 313/495 |
| 6,985,141 | B2 * | 1/2006 | Abe et al. | 345/204 |
| 7,034,793 | B2 * | 4/2006 | Sekiya et al. | 345/98 |
| 7,154,489 | B2 * | 12/2006 | Abe et al. | 345/204 |
| 7,176,868 | B2 * | 2/2007 | Kudo et al. | 345/89 |
| 7,227,519 | B1 * | 6/2007 | Kawase et al. | 345/77 |
| 7,292,236 | B2 * | 11/2007 | Abe et al. | 345/204 |
| 7,330,162 | B2 * | 2/2008 | Yamazaki et al. | 345/82 |
| 2001/0017610 | A1 * | 8/2001 | Ozawa | 345/100 |
| 2002/0075255 | A1 | 6/2002 | Baek et al. | |
| 2002/0109650 | A1 * | 8/2002 | Kougami et al. | 345/60 |
| 2002/0175907 | A1 * | 11/2002 | Sekiya et al. | 345/211 |
| 2003/0016189 | A1 * | 1/2003 | Abe et al. | 345/55 |
| 2003/0095085 | A1 | 5/2003 | Abe | |
| 2003/0112372 | A1 * | 6/2003 | Weaver et al. | 348/555 |
| 2003/0137521 | A1 * | 7/2003 | Zehner et al. | 345/589 |
| 2003/0160804 | A1 | 8/2003 | Willis et al. | |
| 2004/0227711 | A1 * | 11/2004 | Kudo et al. | 345/87 |
| 2005/0001812 | A1 * | 1/2005 | Amundson et al. | 345/107 |
| 2005/0001827 | A1 * | 1/2005 | Abe et al. | 345/204 |
| 2005/0068270 | A1 * | 3/2005 | Awakura et al. | 345/76 |
| 2005/0231498 | A1 * | 10/2005 | Abe et al. | 345/204 |

FOREIGN PATENT DOCUMENTS

| | | |
|---|---|---|
| JP | 06-295160 | 10/1994 |
| WO | WO 03/044765 | 5/2003 |

OTHER PUBLICATIONS

*The Registration Determination Certificate* from the Chinese Patent Office issued in Applicant's corresponding Chinese Patent Application No. ZL200510067794.4 dated Nov. 12, 2008.

* cited by examiner

ELECTRON EMISSION DISPLAY (EED) DEVICE WITH VARIABLE EXPRESSION RANGE OF GRAY LEVEL

CLAIM OF PRIORITY

This application makes reference to, incorporates the same herein, and claims all benefits accruing under 35 U.S.C. §119 from an application for ELECTRON EMISSION DISPLAY DEVICE WITH VARIABLE EXPRESSION RANGE OF GRAY LEVEL earlier filed in the Korean Intellectual Property Office on Apr. 29, 2004 and there duly assigned Ser. No. 10-2004-0030006.

BACKGROUND OF THE INVENTION

1. Field of the Invention

The present invention relates to an Electron Emission Display (EED) device which can adjust a pulse width of a data signal supplied to data electrode lines of a panel, and more particularly, to an EED device which can actively adjust a pulse width of a data signal using a predefined waveform or a predefined pointer according to an active pulse width of a horizontal synchronization signal.

2. Description of the Related Art

An Electron Emission Display (EED) device includes an EED panel and a driver. When the driver supplies a positive voltage to an anode of the EED panel, if the positive voltage is supplied to a gate electrode and a negative voltage is supplied to a cathode electrode, electrons are emitted from the cathode. The emitted electrons are accelerated toward the gate electrode and converged into the anode. Then, the electrons collide with fluorescent cells disposed in front of the anode, thereby emitting light.

An EED device includes an EED panel and a driver. The driver includes a video processor, a panel controller, a scan driver, a data driver, and a power supply unit.

The video processor converts an external analog video signal into a digital signal to generate an internal video signal, for example, R, G and B video data, a clock signal, and horizontal and vertical synchronization signals.

The panel controller generates data driving control signals and scan driving control signal according to the internal video signal outputted from the video processor. The data driver processes the data driving control signal and outputs a display data signal to data electrode lines of the EED panel. The scan driver processes the scan driving control signal SS and supplies the processed signal to scan electrode lines.

The power supply unit supplies an electrical potential of 1 to 4 KV to the video processor, the panel controller, the scan driver, the data driver, and an anode electrode of the EED panel. The data electrode lines are connected to cathode electrodes of the EED panel and the scan electrode lines are connected to gate electrodes. When a positive voltage is supplied to the anode, if the positive voltage is supplied to the gate electrodes through the scan electrode lines and a negative voltage is supplied to the cathode electrodes through the data electrode lines, then electrons are emitted from the cathode. The emitted electrons are accelerated toward the gate electrodes and converged into the anodes. Then, the electrons collide with fluorescent cells disposed in front of the anodes, thereby emitting light.

Gray level control methods for adjusting the luminance of the EED panel include a Pulse Width Modulation (PWM) method which controls an amount of time that a data signal pulse is supplied and Pulse Amplitude Modulation (PAM) method which controls a voltage amplitude of data signal pulse.

In the PWM method, a reference signal generated by a reference signal generator is counted by a gray level signal generator and a gray level signal counted at every proper reference signal is outputted to the data driver. The data driver outputs a PWM-ed data signal to the data electrode lines according to the gray level signal.

In a modulation module which modulates the pulse width of the data signal in the EED device adopting the PWM scheme, the reference signal generator generates the reference signal for modulating the pulse width of the data signal according to a high speed system clock. An active period (+or − period of the waveform) of the pulse waveform or one period of the pulse is fixed so that the waveform of the reference signal is suitable for the horizontal synchronization signal supplied to the EED panel.

The gray level signal generator counts the reference signal to generate the gray level signal. The gray level signal is a signal that is counted from just after a clear signal has been inputted, every time that the reference signal is supplied. The gray level signal has a waveform in which a pulse width increases according to the count or a waveform in which a position of the pulse is shifted in a horizontal direction according to the count. The gray level signal is inputted to a modulation comparator, and the modulation comparator compares the video data with the gray level signal. If the video data and the gray level signal have the same data value, the modulation comparator outputs a signal having a corresponding pulse width. Therefore, the pulse width of an output data signal is adjusted according to size of the video signal. As a result, data signals whose light intensity have been adjusted by the different pulse width are outputted to the data electrode lines. The modulation comparator is generally provided inside the data driver.

In case of PWM, the light intensity is controlled according to the pulse width of the data signal, and in case of PAM, the light intensity is controlled by adjusting the voltage amplitude of the data signal. PAM has an advantage of low power consumption and high output luminance. However, even if the voltage is increased slightly, the control of the luminance according to the voltage difference is difficult owing to a rapid increase of the output current. For these reasons, PWM is widely used.

In the EED device using PWM, the gray level depends on the horizontal synchronization signal. Whenever the horizontal synchronization signal is supplied, data is supplied to one line (that is, one row) of the EED panel. All minimum gray level data and maximum gray level data are supplied to one line while one horizontal synchronization signal is supplied. In case of the EED device using 256 gray levels, a width corresponding to an active pulse width of one horizontal synchronization signal is used as a maximum gray level.

In an EED device having a fixed modulation pulse width with respect to such gray levels, if the gray levels are leveled up, gray levels exceeding the active pulse width of one horizontal synchronization signal cannot be expressed. Thus, the luminance of the panel is degraded. Also, in an EED device that does not require high gray levels, if the active pulse width of one horizontal synchronization signal is made narrow, it is necessary to redesign the system to match with the gray levels according to the new modulation pulse width.

The horizontal synchronization signal and the reference signal are dependent on the high frequency system clock and the gray level signals are generated by counting the reference signal. The EED device uses 256 gray levels and the panel expresses 0-255 gray levels. All gray levels are present within the active pulse width of the horizontal synchronization signal and the maximum gray level (255 gray level) is also present within the active pulse width of the horizontal synchronization signal. However, when gray levels exceed 255 gray level owing to the modification of the system, or when the active pulse width of the horizontal synchronization signal is reduced, it is impossible to express the gray levels exceeding the active pulse width of the horizontal synchronization signal. Therefore, problems occur in that the expression range of the gray level is reduced and the luminance is lowered.

SUMMARY OF THE INVENTION

In accordance with one aspect of the present invention, an Electron Emission Display (EED) device is provided comprising: a scan driver: a data driver; an EED panel adapted to display a display data signal according to a scan signal of the scan driver, the display data signal obtained by modulating a pulse width of video data from the data driver; a reference signal memory adapted to store a lookup table of active pulse widths of horizontal synchronization signals defined by a system clock and reference signals corresponding to the active pulse widths of the horizontal synchronization signals; a reference signal referring unit adapted to output a reference signal in accordance with the lookup table stored in the reference signal memory; and a gray level signal generator adapted to count the reference signal and output a gray level signal to the data driver; wherein the data driver outputs the display data signal corresponding to the gray level signal and the video data to data electrode lines of the EED panel.

The EED device preferably further comprises a synchronization signal counter adapted to examine the active pulse width of a horizontal synchronization signal.

The synchronization signal counter is preferably adapted to count the horizontal synchronization signal based on the system clock and to output an active pulse width value of the horizontal synchronization signal to the reference signal referring unit.

The reference signal memory preferably includes a lookup table adapted to store waveform data of the reference signals corresponding to the active pulse widths of the horizontal synchronization signals.

The lookup table is preferably adapted to store waveform data of the reference signals whose 1-pulse cycles are adjusted to correspond to the active pulse widths of the horizontal synchronization signals.

The 1-pulse cycles are preferably multiples of a clock pulse width of the system clock.

The lookup table is preferably adapted to store waveform data of the reference signals whose pulse widths have been adjusted to correspond to the active pulse widths of the horizontal synchronization signals.

The pulse widths represented by the waveform data of the reference signals are preferably multiples of a pulse width of the system clock.

The reference signal memory preferably includes a lookup table adapted to store offset pointers of reference signals corresponding to the active pulse widths of the horizontal synchronization signals with respect to the system clock.

The offset pointers of the reference signals preferably represent rising and falling time points of the reference signals with respect to the system clock.

The offset pointers are preferably set at every multiple of a pulse width of the system clock.

The data driver preferably comprises: a shift register adapted to sequentially store serial video data of one horizontal line; a latch register adapted to convert the serial video data into parallel video data; and a modulation comparator adapted to compare the parallel video data of the latch register with the gray level signal of the gray level signal generator and to output thePulse Width Modulation (PWM) display data signal to data electrode lines upon the parallel video data coinciding with the gray level signal.

In accordance with another aspect of the present invention, a method of driving an Electron Emission Display (EED) which displays a display data signal on an EED panel according to scan signal of a scan driver, the display data signal being obtained by modulating a pulse width of a video data at a data driver, the method comprising: creating a lookup table of active pulse widths of horizontal synchronization signals and reference signals corresponding to the active pulse widths of the horizontal synchronization signals, based on a system clock; examining an active pulse width of a horizontal synchronization signal; generating a reference signal in accordance with the lookup table stored in a reference signal memory according to the active pulse width of the horizontal synchronization signal; counting the reference signal to generate a gray level signal; and outputting the display data signal corresponding to a pulse width of the gray level signal and the video signal to data electrode lines of the EED panel.

Examining the active pulse width of the horizontal synchronization signal preferably comprises counting the horizontal synchronization signal, based on the system clock, to calculate an active pulse width value.

Creating the lookup table preferably comprises storing waveform data of reference signals corresponding to the active pulse widths of the horizontal synchronization signals in the lookup table according to the system clock.

Creating the lookup table preferably comprises storing offset pointers of reference signals corresponding to the active pulse widths of the horizontal synchronization signals in the lookup table with respect to rising and falling time points of the reference signals according to the system clock.

Outputting the display data signal preferably comprises: sequentially storing serial video data of one horizontal line in a shift register; storing the serial video image data received from the shift register as parallel video data in a latch register; comparing the parallel video data of the latch register and the gray level signal; and outputting the Pulse Width Modulated (PWM) display data signal to data electrode lines upon the parallel video data coinciding with the gray level signal.

BRIEF DESCRIPTION OF THE DRAWINGS

A more complete appreciation of the present invention, and many of the attendant advantages thereof, will be readily apparent as the present invention becomes better understood by reference to the following detailed description when considered in conjunction with the accompanying drawings in which like reference symbols indicate the same or similar components, wherein.

DETAILED DESCRIPTION OF THE INVENTION

Figure 1:
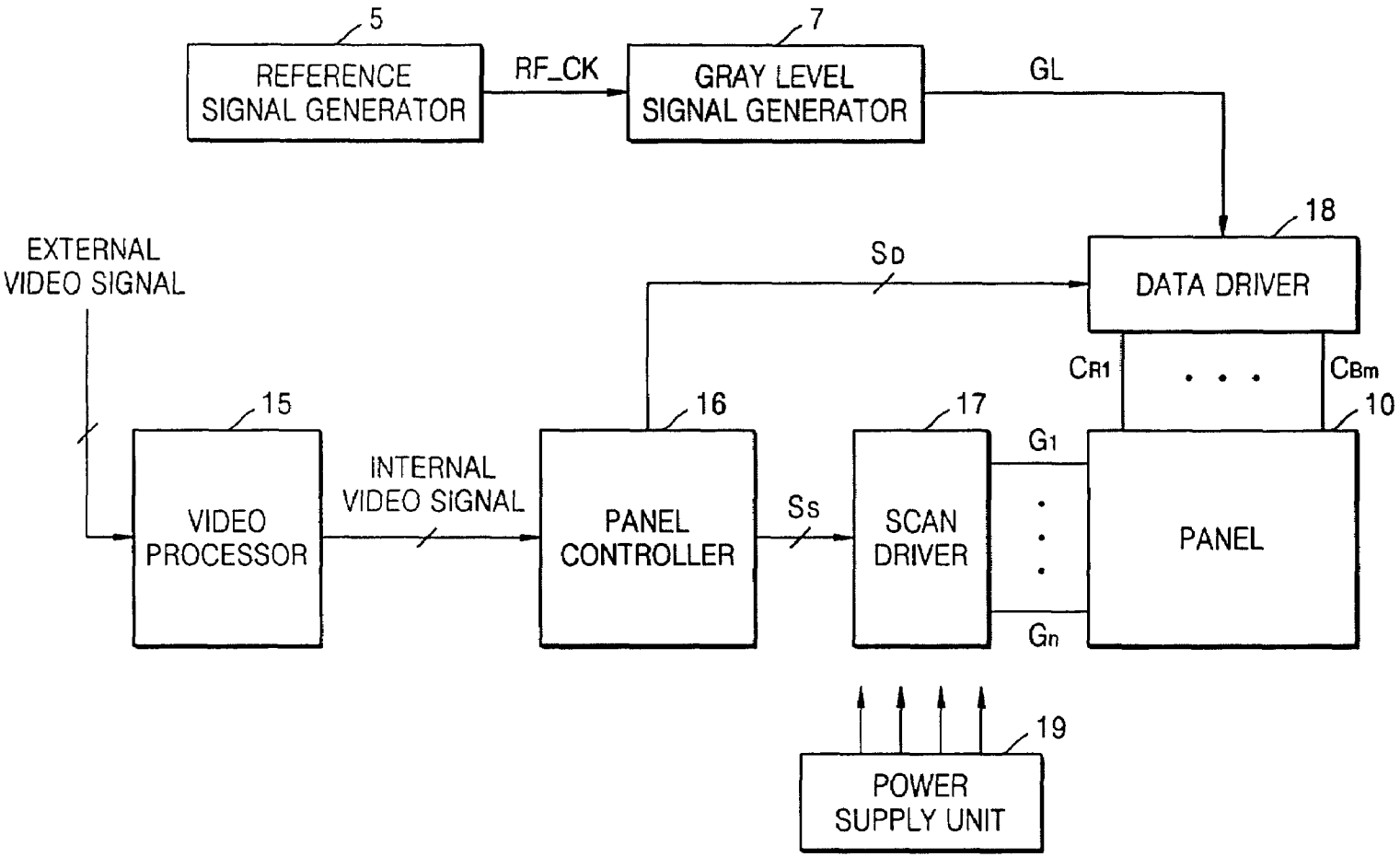
FIG. 1 is a schematic block diagram of an EED device.

FIG. 1 is a schematic block diagram of an EED device.

Referring to FIG. 1, an EED device includes an EED panel 10 and a driver. The driver includes a video processor 15, a panel controller 16, a scan driver 17, a data driver 18, and a power supply unit 19.

The video processor 15 converts an external analog video signal into a digital signal to generate an internal video signal, for example, R, G and B video data, a clock signal, and horizontal and vertical synchronization signals.

The panel controller 16 generates data driving control signals SD and scan driving control signal SS according to the internal video signal outputted from the video processor 15. The data driver 18 processes the data driving control signal SD and outputs a display data signal to data electrode lines $C_{R1}$ to $C_{Bm}$ of the EED panel 10. The scan driver 17 processes the scan driving control signal SS and supplies the processed signal to scan electrode lines $G_1$ to $G_n$.

The power supply unit 19 supplies an electrical potential of 1 to 4 KV to the video processor 15, the panel controller 16, the scan driver 17, the data driver 18, and an anode electrode of the EED panel 10. The data electrode lines $C_{R1}$ to $C_{Bm}$ are connected to cathode electrodes of the EED panel 10 and the scan electrode lines $G_1$ to $G_n$ are connected to gate electrodes. When a positive voltage is supplied to the anode, if the positive voltage is supplied to the gate electrodes through the scan electrode lines $G_1$ to $G_n$ and a negative voltage is supplied to the cathode electrodes through the data electrode lines $C_{R1}$ to $C_{Bm}$, then electrons are emitted from the cathode. The emitted electrons are accelerated toward the gate electrodes and converged into the anodes. Then, the electrons collide with fluorescent cells disposed in front of the anodes, thereby emitting light.

Gray level control methods for adjusting the luminance of the EED panel 10 include a Pulse Width Modulation (PWM) method which controls an amount of time that the display data signal is supplied and Pulse Amplitude Modulation (PAM) method which controls a voltage amplitude of the display data signal.

In the PWM method, a reference signal RF_CK generated by a reference signal generator 5 of FIG. 1 is counted by a gray level signal generator 7 and a gray level signal GL counted at every proper reference signal is outputted to the data driver 18. The data driver 18 outputs the PWM-ed display data signal to the data electrode lines $C_{R1}$ to $C_{Bm}$ according to the gray level signal GL.

Figure 2:
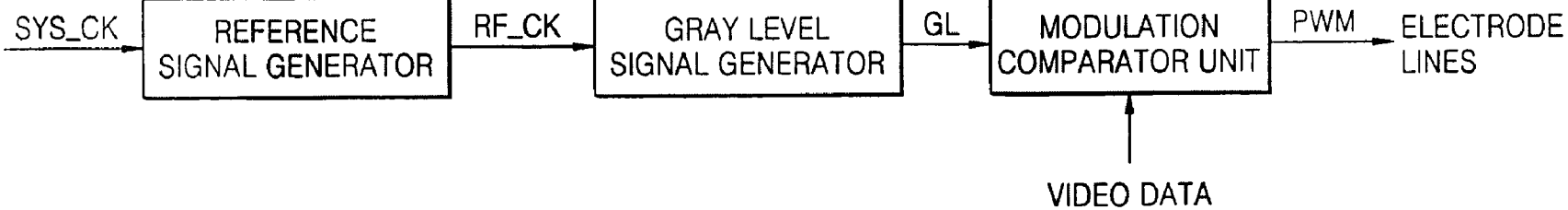
FIG. 2 is a block diagram of a modulation module which generates a reference signal and a gray level signal in an EED device.

FIG. 2 is a block diagram of a modulation module which modulates the pulse width of the data signal in the EED device adopting the PWM scheme. The reference signal generator 5 generates the reference signal RF_CK for modulating the pulse width of the display data signal according to a high speed system clock SYS_CK. An active period (+or – period of the waveform) of the pulse waveform or one period of the pulse is fixed so that the waveform of the reference signal RF_CK is suitable for the horizontal synchronization signal supplied to the EED panel 10.

The gray level signal generator 7 counts the reference signal RF_CK to generate the gray level signal GL. The gray level signal GL is a signal that is counted from just after a clear signal has been inputted, every time that the reference signal RF_CK is supplied. The gray level signal GL has a waveform in which a pulse width increases according to the count or a waveform in which a position of the pulse is shifted in a horizontal direction according to the count. The gray level signal GL is inputted to a modulation comparator 8, and the modulation comparator 8 compares the video data with the gray level signal GL. If the video data and the gray level signal GL have the same data value, the modulation comparator 8 outputs a signal having a corresponding pulse width. Therefore, the pulse width of the output display data signal is adjusted according to size of the video signal. As a result, display data signals whose light intensity have been adjusted by the different pulse width are outputted to the data electrode lines $C_{R1}$ to $C_{Bm}$. The modulation comparator 8 is generally provided inside the data driver 18.

In case of PWM, the light intensity is controlled according to the pulse width of the display data signal, and in case of PAM, the light intensity is controlled by adjusting the voltage amplitude of the display data signal. PAM has an advantage of low power consumption and high output luminance. However, even if the voltage is increased slightly, the control of the luminance according to the voltage difference is difficult owing to a rapid increase of the output current. For these reasons, PWM is widely used.

In the EED device using PWM, the gray level depends on the horizontal synchronization signal. Whenever the horizontal synchronization signal is supplied, data is supplied to one line (that is, one row) of the EED panel 10. All minimum gray level data and maximum gray level data are supplied to one line while one horizontal synchronization signal is supplied. In case of the EED device using 256 gray levels, a width corresponding to an active pulse width of one horizontal synchronization signal is used as a maximum gray level.

In an EED device having a fixed modulation pulse width with respect to such gray levels, if the gray levels are leveled up, gray levels exceeding the active pulse width of one horizontal synchronization signal cannot be expressed. Thus, the luminance of the panel is degraded. Also, in an EED device that does not require high gray levels, if the active pulse width of one horizontal synchronization signal is made narrow, it is necessary to redesign the system to match with the gray levels according to the new modulation pulse width.

Figure 3:
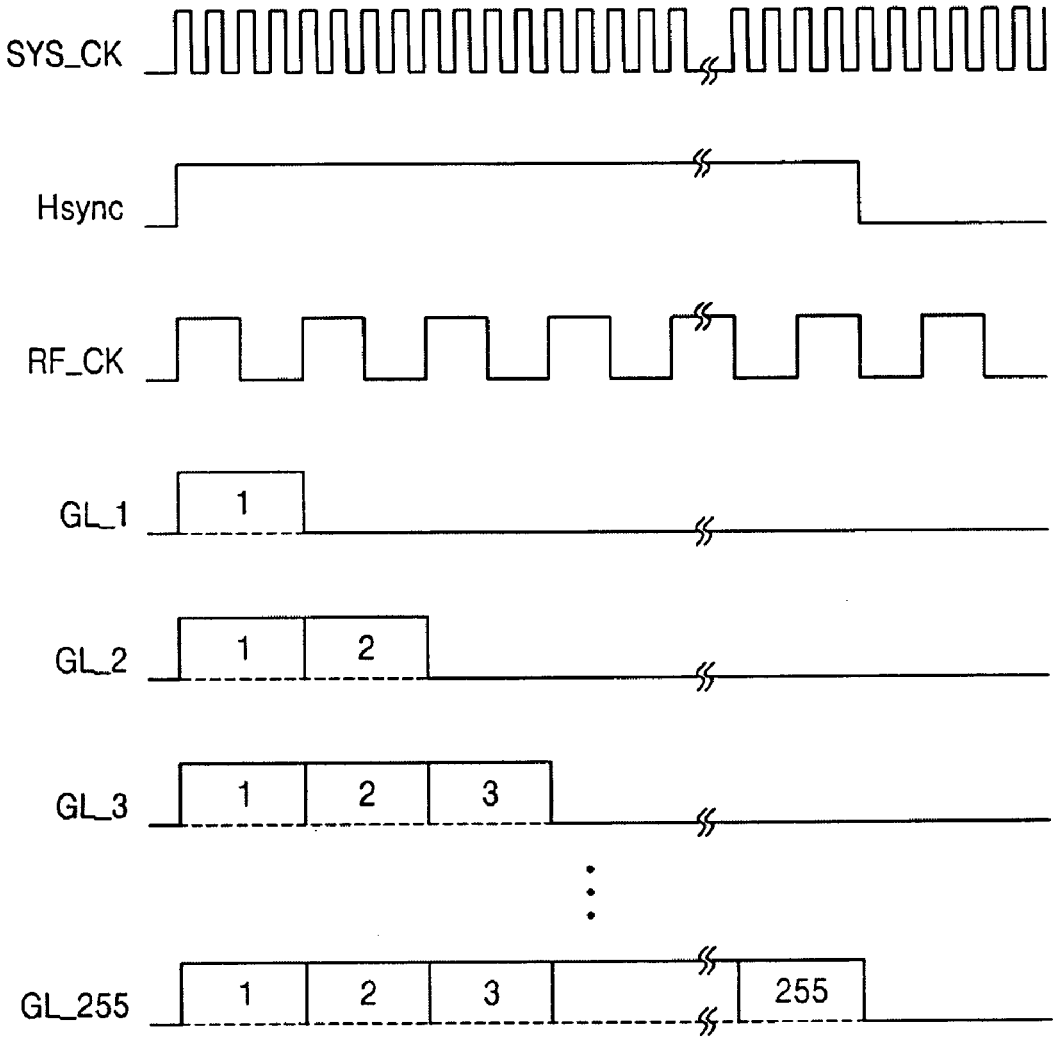
FIG. 3 is a waveform of a reference signal and a gray level signal depending on a horizontal synchronization signal in the EED device.

FIG. 3 is a waveform of the reference signal and the gray level signals for the active pulse width of the horizontal synchronization signal in an EED device. The horizontal synchronization signal Hsync and the reference signal RF_CK are dependent on the high frequency system clock SYS_CK and the gray level signals GL are generated by counting the reference signal RF_CK. In FIG. 3, the EED device uses 256 gray levels and the panel expresses 0-255 gray levels. All gray levels are present within the active pulse width of the horizontal synchronization signal Hsync and the maximum gray level (255 gray level) is also present within the active pulse width of the horizontal synchronization signal Hsync. However, when gray levels exceed 255 gray level owing to the modification of the system, or when the active pulse width of the horizontal synchronization signal Hsync is reduced, it is impossible to express the gray levels exceeding the active pulse width of the horizontal synchronization signal Hsync. Therefore, problems occur in that the expression range of the gray level is reduced and the luminance is lowered.

The present invention will now be described more fully with reference to the accompanying drawings, in which exemplary embodiments of the present invention are shown.

Figure 4:
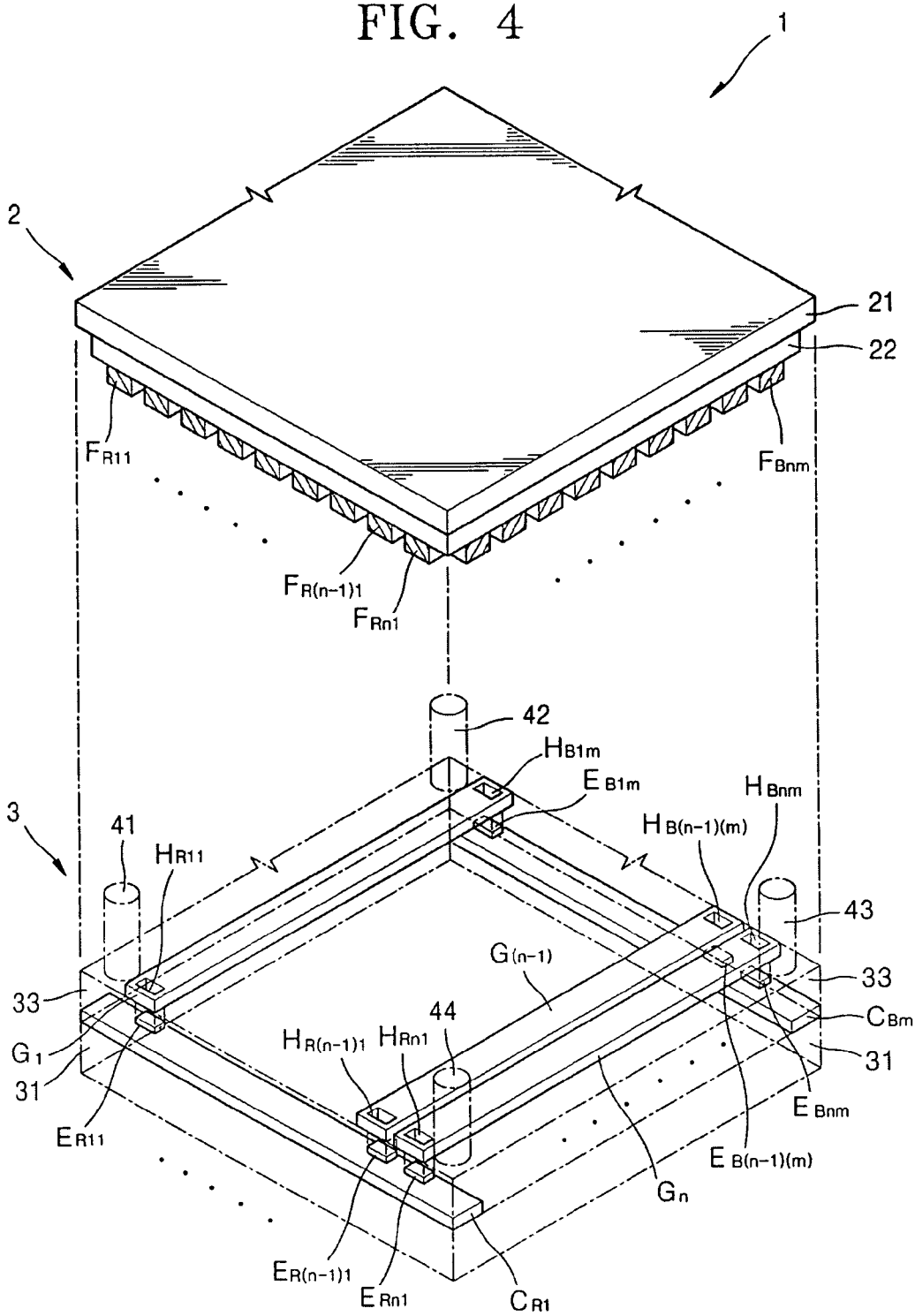
FIG. 4 is an exploded perspective view of an EED panel in an EED device according to an embodiment of the present invention.

FIG. 4 is an exploded perspective view of an EED panel in an EED device according to an embodiment of the present invention.

Referring to FIG. 4, an EED panel 1 includes a front panel 2 and a rear panel 3, which are supported by space bars 41 to 43.

The rear panel 3 includes a rear substrate 31, cathode electrode lines $C_{R1}$ to $C_{Bm}$, electron emitting sources $E_{R11}$ to $E_{Bnm}$, an insulating layer 33, and gate electrode lines $G_1$ to $G_n$.

Data signals are supplied to the cathode electrode lines $C_{R1}$ to $C_{Bm}$. The cathode electrode lines $C_{R1}$ to $C_{Bm}$ are electrically connected to the electron emitting sources $ER_{11}$ to $E_{Bnm}$ Through-holes $H_{R11}$ to $H_{Bnm}$ corresponding to the electron emitting sources $E_{R11}$ to $E_{Bnm}$ are formed in a first insulating layer 33 and the gate electrode lines $G_1$ to $G_n$. The through-holes HR11 to HBnm are formed in the gate electrode lines $G_1$ to $G_n$, at areas where the cathode electrode lines $C_{R1}$ to $C_{Bm}$ intersects with the gate electrode lines.

The front panel 2 includes a front transparent substrate 21, an anode 22, and fluorescent cells $F_{R11}$ to $F_{Bnm}$. A high positive electrical potential of 1-4 KV is supplied to the anode 22, allowing the electrons to move from the electron emitting sources $E_{R11}$ to $E_{Bnm}$ to the fluorescent cells.

Figure 5:
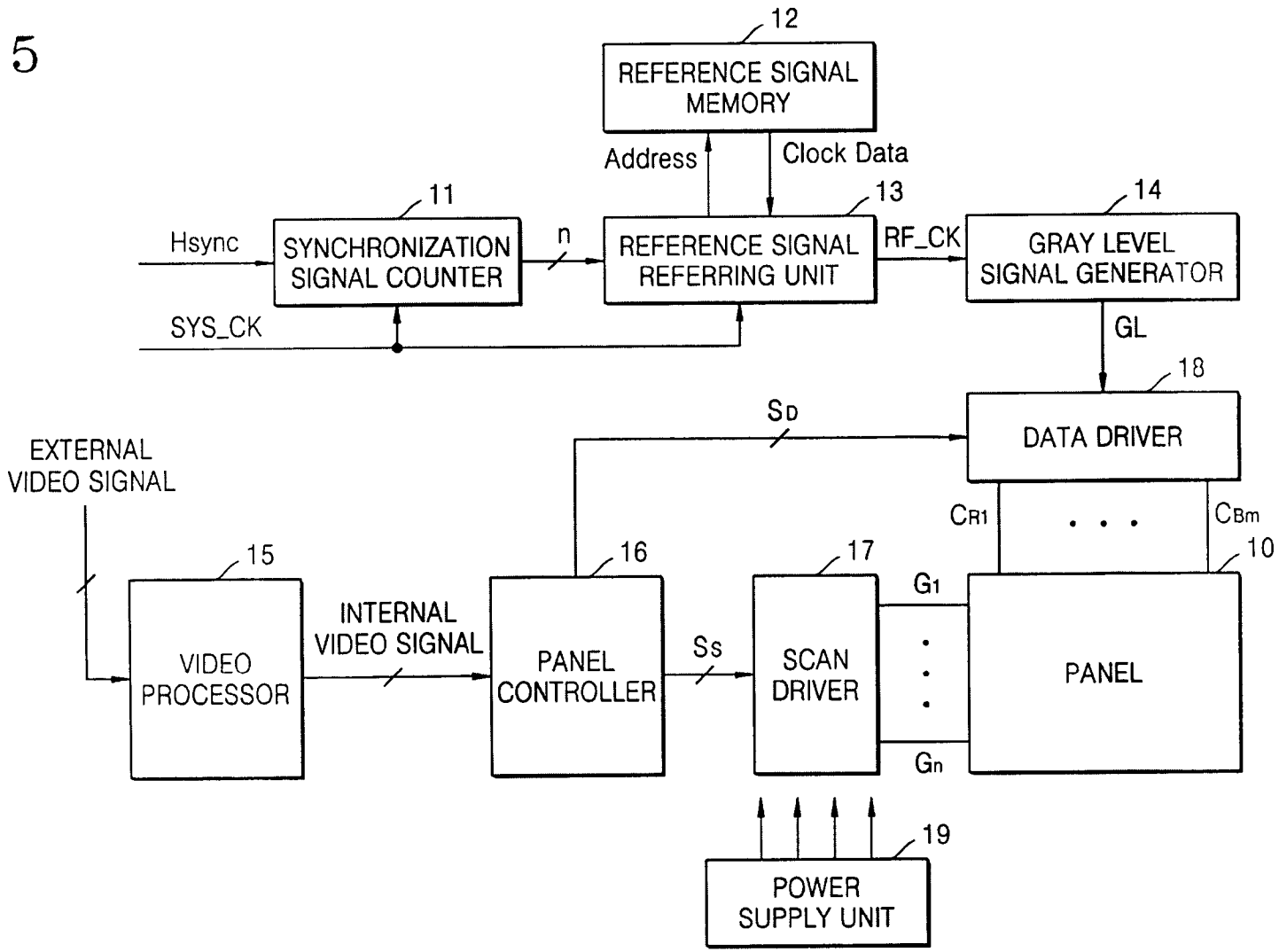
FIG. 5 is a block diagram of an EED device according to an embodiment of the present invention.

FIG. 5 is a block diagram of the EED device according to an embodiment of the present invention.

The EED device includes the EED panel 10 and a driver. The driver for the EED panel 10 includes a video processor 15, a panel controller 16, a scan driver 17, a data driver 18, and a power supply unit 19.

The video processor 15 converts an external analog video signal into a digital video signal to generate an internal video signal. The external analog video signal includes a video signal from computer, a video signal from a digital versatile disc (DVD) player, and a video signal from TV set-top box, and the internal video signal includes 8-bit R, G and B video data, a clock signal, and horizontal and vertical synchronization signals.

The panel controller 16 generates data driving control signals SD and scan driving control signal SS according to the internal video signal outputted from the video processor 15. The data driver 18 processes the data driving control signal SD and outputs a display data signal to data electrode lines $C_{R1}$ to $C_{Bm}$ of the EED panel 10. The scan driver 17 processes the scan driving control signal SS and supplies the processed signal to scan electrode lines $G_1$ to $G_n$.

The power supply unit 19 supplies an electrical potential of 1-4 KV to the video processor 15, the panel controller 16, the scan driver 17, the data driver 18, a synchronization signal counter 11, a reference signal memory 12, a reference signal referring unit 13, and the anode of the EED panel 10.

The reference signal memory 12 has a lookup table including reference signals corresponding to active pulse widths of the horizontal synchronization signals. In one embodiment, the lookup table can have waveform data of the reference signals corresponding to the active pulse widths of the horizontal synchronization signals Hsync. Also, in another embodiment, the lookup table can have offset pointers of the reference signals corresponding to the active pulse widths of the horizontal synchronization signals Hsync. The reference signal memory 12 receives an address signal from the reference signal referring unit 13, finds reference signal data according to the address signal from the lookup table, and outputs the reference signal data to the reference signal referring unit 13.

If the lookup table has waveform data of the reference signals corresponding to the active pulse widths of the horizontal synchronization signals Hsync, the lookup table can have waveform data of the reference signals, whose one pulse cycle or frequency is adjusted to correspond to the active pulse widths of the horizontal synchronization signals. In a further another embodiment, the lookup table can have waveform data of the reference signals, whose pulse widths are adjusted to correspond to the active pulse widths of the horizontal synchronization signals.

Figure 7:
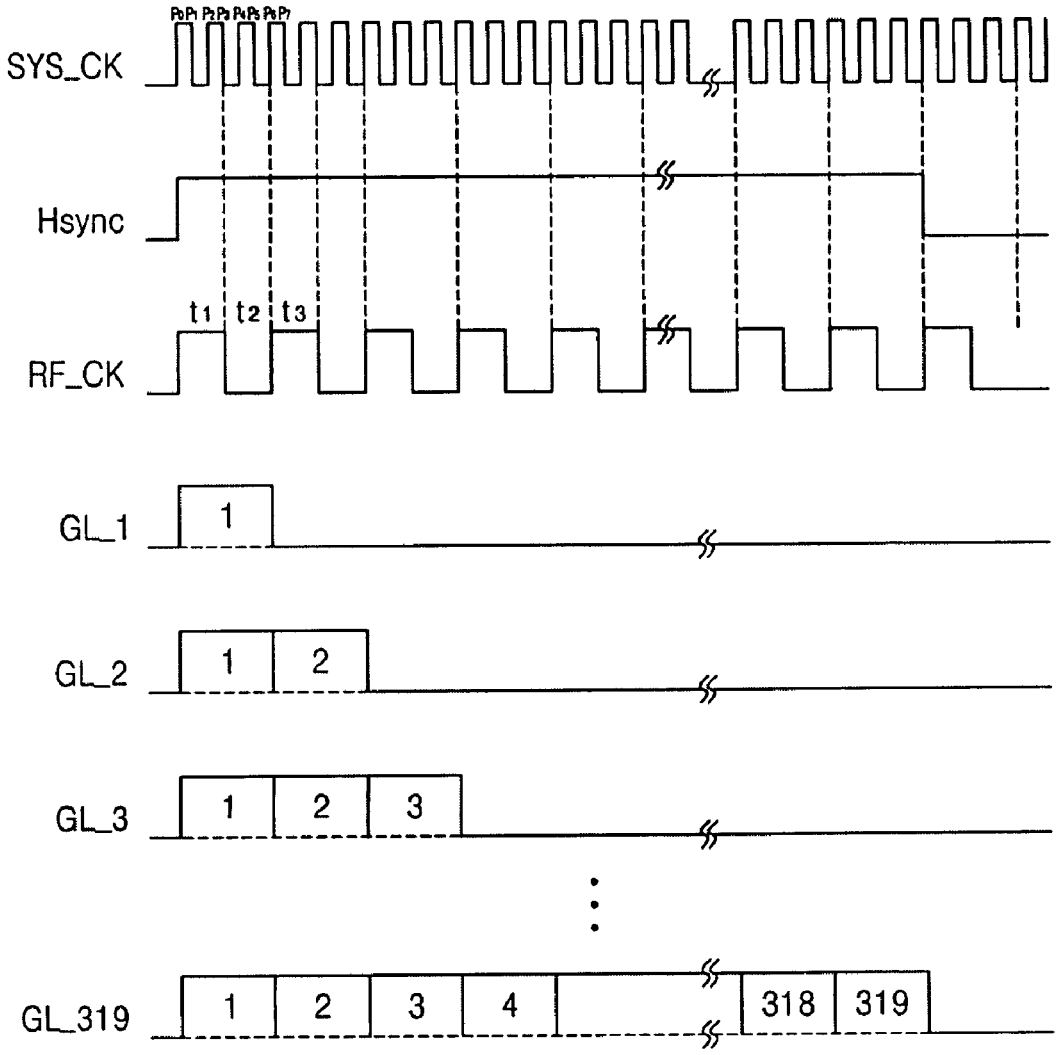
FIG. 7 is a waveform of a reference signal and a gray level signal depending on a horizontal synchronization signal in an EED device according to an embodiment of the present invention.
Figure 8:
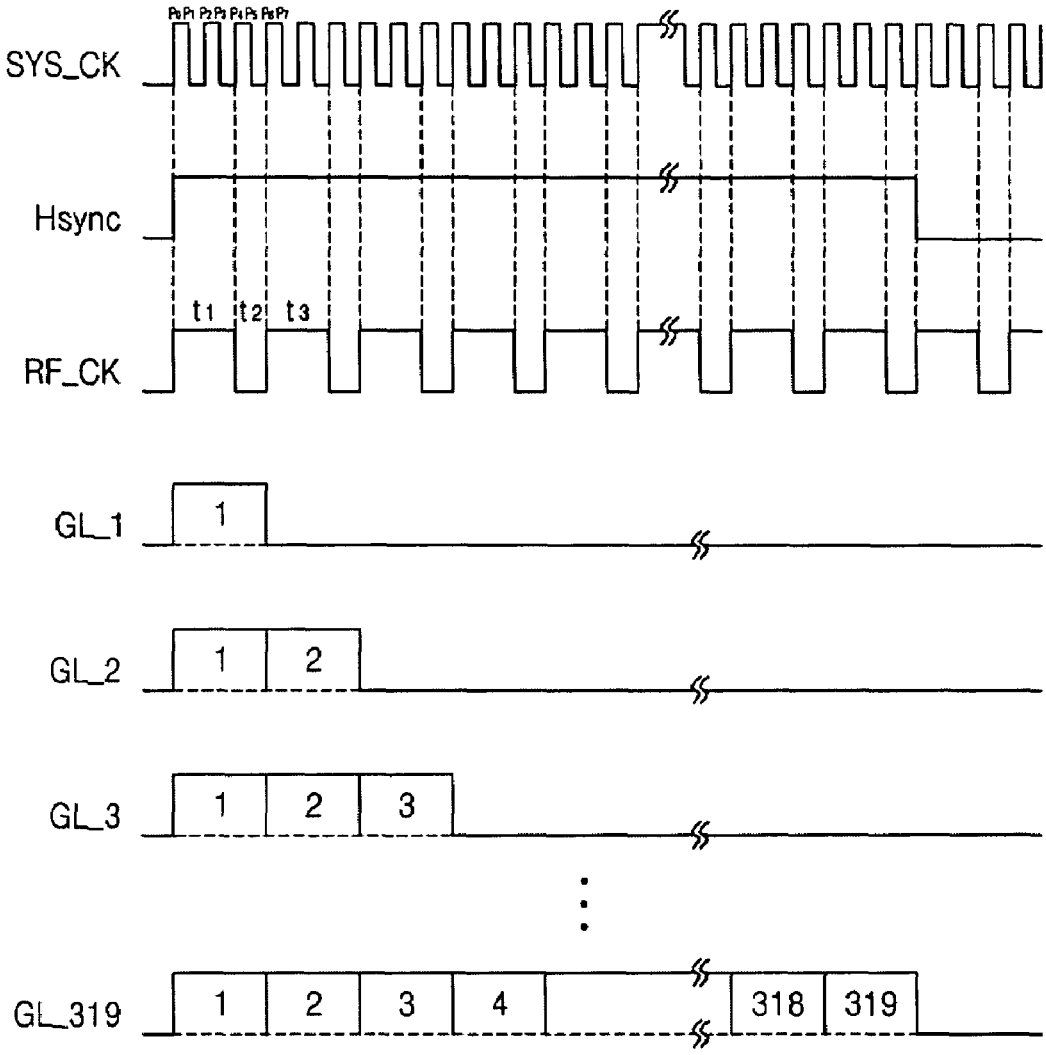
FIG. 8 is a waveform of a reference signal and a gray level signal depending on a horizontal synchronization signal according to an embodiment of the present invention.

FIGS. 7 and 8 are waveforms of the reference signal and gray level signals depending on the horizontal synchronization signals in an EED device according to an embodiment of the present invention.

When the lookup table has waveform data of the reference signals RF_CK, whose one pulse cycle or frequency has been adjusted, one pulse cycle of the reference signal RF_CK can be defined by multiples of a clock pulse width (pulse width of 1 cycle or ½cycle) of the system clock SYS_CK. For example, as can be seen in FIG. 7, the pulse cycle of the reference signal can be defined by 3-cycle clocks of the system clocks SYS_CK. In this case, the (+) pulse cycle and (−) pulse cycle are defined by 1.5 cycle clocks of the system clock SYS_CK. This embodiment can define a waveform, whose cycle is decreased less than the cycle of the reference signal RF_CK for the system clock SYS_CK by 25%, compared with the waveform of FIG. 3. When the cycle is decreased less than the waveform of the reference signal RF_CK by 25% (that is, the frequency is increased by 25%), each of the gray level signals GL has a count pulse decreased by 25%, thereby increasing the expression range of the gray level by 25%. Referring to FIG. 7, the EED device has the expression range of 320 gray levels, which is increased by 25% compared with the expression range of 256 gray levels.

When the lookup table has waveform data of the reference signals RF_CK, whose pulse widths have been adjusted to correspond to the active pulse widths of the horizontal synchronization signals, the pulse width of the reference signals RF_CK can be defined by multiples of a clock pulse width (pulse width of 1 cycle or ½cycle) of the system clock SYS_CK. For example, as can be seen in FIG. 8, the (+) pulse width can be defined by two-cycle clock of the system clock SYS_CK and the (−) pulse width can be defined by one-cycle clock of the system clock SYS_CK. This embodiment can define waveform, whose (+) pulse width is equal and whose (−) pulse width is decreased by 50%, compared with the waveform of FIG. 3. When the (+) pulse width is equal and the (−) pulse width is decreased by 50% (that is, the pulse width of one cycle is increased by 25%), each of the gray level signals GL has a count pulse decreased by 50%, thereby increasing the expression range of the gray level by 25%. Referring to FIG. 8, the EED device has the expression range of 320 gray levels, which is increased by 25% compared with the expression range of 256 gray levels.

In a further embodiment, when the lookup table has offset pointers of the reference signals corresponding to the active pulse widths of the horizontal synchronization signals Hsync, the offset points can define a rising time point t1 and a falling time point t2 of the reference signal RF_CK. The offset pointers can be defined at every multiple of the clock pulse width (pulse width of 1 cycle or ½cycle) of the system clock SYS_CK.

For example, as can be seen in FIG. 7, a zero-th pointer $P_0$ that is a start time point of the system clock SYS_CK can be defined as a rising time point t1 of the reference signal RF_CK, a third pointer $P_3$ as a falling time point t2 of the reference signal RF_CK, and a sixth pointer $P_6$ as a next rising time point t3 of the reference signal RF_CK. Although next rising and falling time points of the clock can be defined, the reference signal RF_CK can be defined using only the three time points t1, t2 and t3 if the reference signal RF_CK has equally repeated waveforms. Accordingly, it is sufficient if the lookup table has at least three offset pointers that define the waveforms of the reference signal with respect to the active pulse width of the horizontal synchronization signal.

Also, as can be seen in FIG. 8, a zero-th pointer $P_0$ that is a start time point of the system clock SYS_CK can be defined as a rising time point t1 of the reference signal RF_CK, a fourth pointer $P_4$ as a falling time point t2 of the reference signal RF_CK, and a sixth pointer $P_6$ as a next rising time point t3 of the reference signal RF_CK. Although next rising and falling time points of the clock can be defined, the reference signal RF_CK can be defined using only the three time points t1, t2 and t3 if the reference signal RF_CK has equally repeated waveforms. Accordingly, it is sufficient if the lookup table has at least three offset pointers that define the waveforms of the reference signals with respect to the active pulse widths of the horizontal synchronization signals.

Referring to FIGS. 7 and 8, the EED device has the expression range of 320 gray levels, which is increased by 25% compared with the expression range of 256 gray levels.

The synchronization signal counter 11 examines the active pulse widths of the horizontal synchronization signals. For example, the synchronization signal counter 11 counts the active pulse widths of the horizontal synchronization signals Hsync based on the system clock SYS_CK and outputs an n-bit data to the reference signal referring unit 13. The active pulse widths of the horizontal synchronization signals are pulse duration periods in which the horizontal synchronization signals are in an on state.

The reference signal referring unit 13 selects the reference signals RF_CK for obtaining required modulation pulse widths with reference to the lookup table of the reference signal memory 12, depending on information about the active pulse widths of the horizontal synchronization signals, which are evaluated by the synchronization signal counter 11. When the lookup table stored in the reference signal memory 12 has the waveform data of the reference signals corresponding to the active pulse widths of the horizontal synchronization signals Hsync (that is, the waveform data such as the cycle or pulse width), the reference signal referring unit 13 outputs the reference signal RF_CK in its own waveform. When the lookup table stored in the reference signal memory 12 has the offset pointers of the reference signals, the waveforms of the reference signals RF_CK based on the system clock SYS_CK are calculated and outputted as the reference signals RF_CK.

The reference signals RF_CK that are selectively outputted from the reference signal referring unit 13 are inputted to a gray level signal generator 14. The gray level signal generator 14 inputs the gray level signals GL to the data driver 18. The gray level signals GL are obtained by counting the reference signals RF_CK. A modulation comparator 185 of the data driver 18 modulates the pulse widths of the video data using the gray level signals GL.

Figure 6:
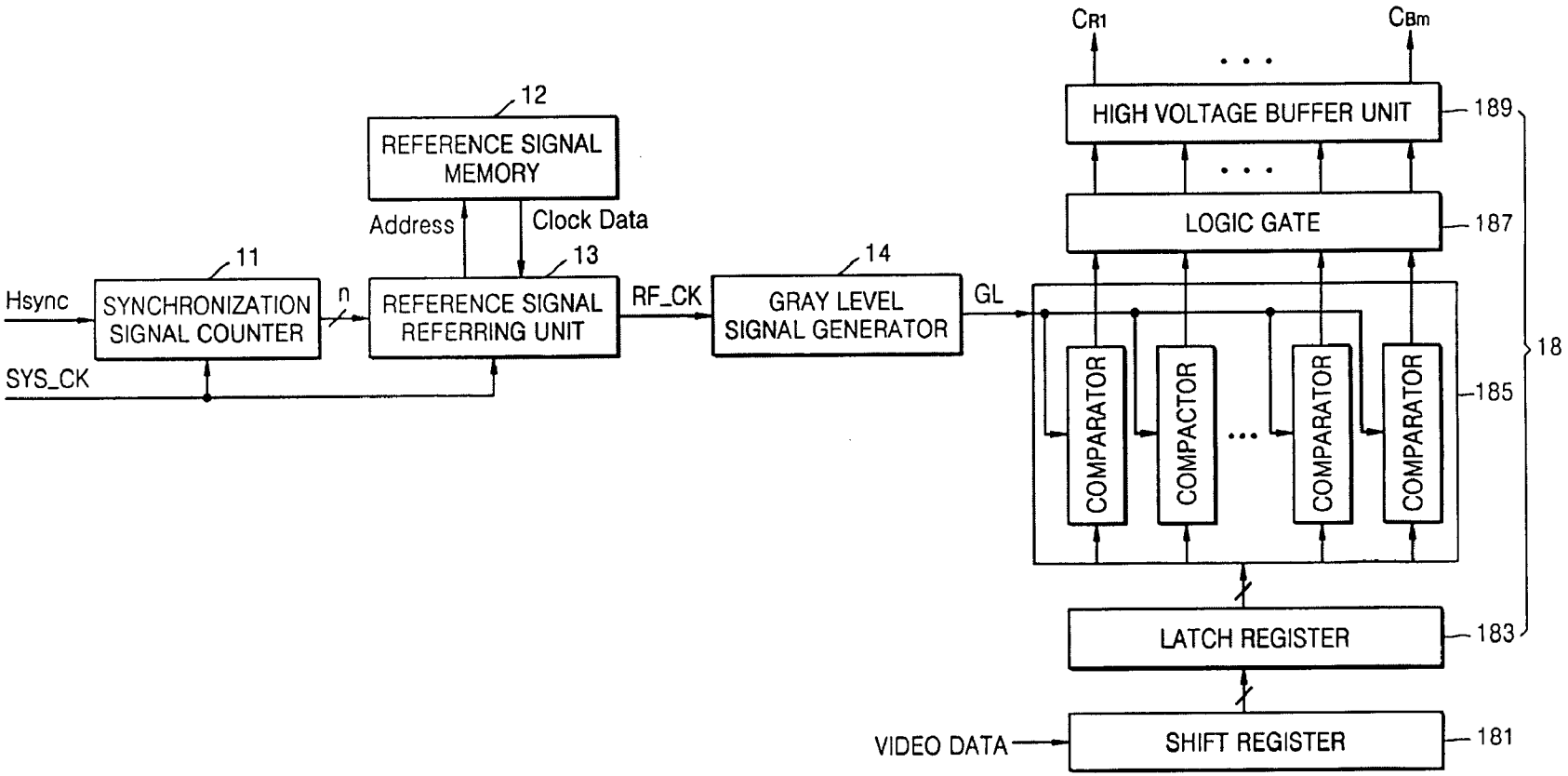
FIG. 6 is a block diagram of a modulation comparator of a data driver which is connected to a gray level signal generator to modulate a pulse width of a video data using a gray level signal in the EED device according to an embodiment of the present invention.

FIG. 6 is a block diagram of the modulation comparator of the data driver, which is connected to the gray level signal generator to modulate the pulse widths of the video data using the gray level signal GL, in the EED device according to an embodiment of the present invention.

Referring to FIG. 6, the data driver 18 includes a shift register 181, a latch register 183, a modulation comparator 185, a logic gate 187, and a high voltage buffer 189. The shift register 181 receives the video data, and the latch register 183 temporarily stores a set of the video data in parallel. The modulation comparator 185 compares the parallel video data with the respective gray levels GL and outputs the video signals whenever the parallel video data coincides with the gray levels. The logic gate 187 and the high voltage buffer 189 finally output the modulated signals to the data electrode lines $C_{R1}$ to $C_{Bm}$.

The shift register 181 of the data driver 18 sequentially receives and stores the video data of one horizontal line. The video data is inputted from the panel controller 16. The shift register 181 of the data driver 18 functions to store serial video data of one horizontal line and output them as parallel video data, not to shift the video data. The latch register 183 receives and stores the parallel video data of one horizontal line from the shift register 181, and then, transmits the parallel video data of one horizontal line to the modulation comparator 185 at the same time if an output enable signal is inputted.

The modulation comparator 185 compares the parallel video data of the latch register 183 with the gray level signal GL of the reference signal referring unit 13. If the parallel video data coincides with the gray level signal GL, the modulation comparator 185 outputs the parallel video data as the PWM display data signals to the data electrode lines $C_{R1}$ to $C_{Bm}$. If necessary, the logic gate 187 adjusts the modulated parallel video data, that is, the PWM display data signal, through a logic combination. For example, when the electrode connected to the data electrode lines $C_{R1}$ to $C_{Bm}$ is the cathode, the voltage pulse of the display data signal is inverted into a reverse phase. The high voltage buffer 189 increases an amplitude of the PWM display data signal up to a high voltage level corresponding to the electrode (for example, the cathode or the gate electrode) connected to the data electrode lines $C_{R1}$ to $C_{Bm}$.

Figure 9:
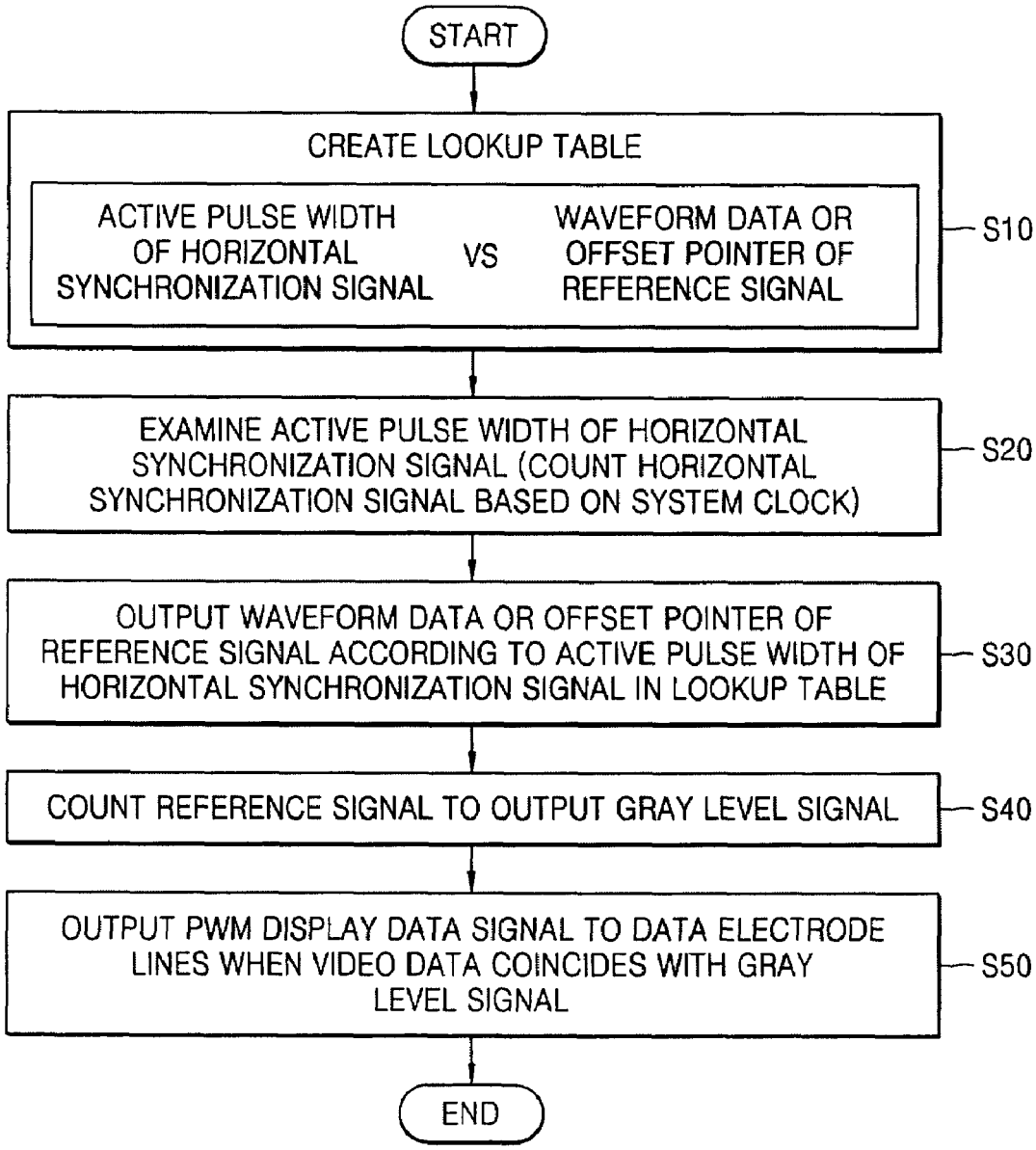
FIG. 9 is a flowchart of a method of driving an EED device according to an embodiment of the present invention.

FIG. 9 is a flowchart of a method of driving the EED device according to the present invention. According to the driving method of the present invention, the data driver modulates the pulse widths of the video data, thereby obtaining the display data signals. Then, the display data signals are outputted to the EED panel according to the scan signal of the scan driver. In order to allow the corresponding gray level to be expressed even when the active pulse widths of the horizontal synchronization signals are narrower than the pulse widths of the data signals of the gray level intended to be expressed, the driving method of the present invention analyzes the horizontal synchronization signal and then adjusts the modulation pulse width of the data signal with reference to the lookup table.

Referring to FIG. 9, the active pulse widths of the horizontal synchronization signals and the reference signals corresponding to the active pulse widths are included in the lookup table according to the system clock (S10).

In one embodiment, creating the lookup table includes including the waveform data corresponding to the active pulse widths of the horizontal synchronization signals in the lookup table according to the system clock.

When the lookup table has waveform data of the reference signals RF_CK, whose one pulse cycle or frequency is adjusted, one pulse cycle of the reference signals RF_CK can be defined by multiples of a clock pulse width (pulse width of 1 cycle or ½cycle) of the system clock SYS_CK. For example, as can be seen in FIG. 7, the pulse cycle of the reference signals can be defined by 3-cycle clocks of the system clocks SYS_CK. In this case, the (+) pulse cycle and the (−) pulse cycle are defined by 1.5 cycle clocks of the system clock SYS_CK. This embodiment can define waveform, whose cycle is decreased less than the cycle of the reference signal RF_CK for the system clock SYS_CK by 25%, compared with the waveform of FIG. 3. When the cycle is decreased less than the waveform of the reference signal RF_CK by 25% (that is, the frequency is increased by 25%), each of the gray level signals GL has a count pulse decreased by 25%, thereby increasing the expression range of the gray level by 25%. Referring to FIG. 7, the EED device has the expression range of 320 gray levels, which is increased by 25% compared with the expression range of 256 gray levels.

When the lookup table has waveform data of the reference signals RF_CK, whose pulse widths are adjusted to correspond to the active pulse widths of the horizontal synchronization signals, the pulse widths of the reference signals RF_CK can be defined by multiples of a clock pulse width (pulse width of 1 cycle or ½cycle) of the system clock SYS_CK. For example, as can be seen in FIG. 8, the (+) pulse width can be defined by two-cycle clock of the system clock SYS_CK and the (−) pulse width can be defined by one-cycle clock of the system clock SYS_CK. This embodiment can define waveform, whose (+) pulse width is equal and whose (−) pulse width is decreased by 50%, compared with the waveform of FIG. 3. When the (+) pulse width is equal and the (−) pulse width is decreased by 50% (that is, the pulse width of one cycle is increased by 25%), each of the gray level signals GL has a count pulse decreased by 50%, thereby increasing the expression range of the gray level by 25%. Referring to FIG. 8, the EED device has the expression range of 320 gray levels, which is increased by 25% compared with the expression range of 256 gray levels.

In another embodiment, the creating of the lookup table includes including offset pointers of the reference signals corresponding to the active pulse widths of the horizontal synchronization signals in the lookup table with respect to the rising and falling time points of the reference signal according to the system clock.

In this embodiment, when the lookup table has the offset pointers of the reference signals corresponding to the active pulse widths of the horizontal synchronization signals Hsync, the offset points can define a rising time point t1 and a falling time point t2 of the reference signal RF_CK. The offset pointers can be defined at every multiple of the clock pulse width (pulse width of 1 cycle or ½cycle) of the system clock SYS_CK.

For example, as can be seen in FIG. 7, a zero-th pointer $P_0$ that is a start time point of the system clock SYS_CK can be defined as a rising time point t1 of the reference signal RF_CK, a third pointer P3 as a falling time point t2 of the reference signal RF_CK, and a sixth pointer P6 as a next rising time point t3 of the reference signal RF_CK. Although next rising and falling time points of the clock can be defined, the reference signal RF_CK can be defined using only the three time points t1, t2 and t3 if the reference signal RF_CK has equally repeated waveforms. Accordingly, it is sufficient if the lookup table has at least three offset pointers that define the waveforms of the reference signal with respect to the active pulse width of the horizontal synchronization signal.

Also, as can be seen in FIG. 8, a zero-th pointer $P_0$ that is a start time point of the system clock SYS_CK can be defined as a rising time point t1 of the reference signal RF_CK, a fourth pointer $P_4$ as a falling time point t2 of the reference signal RF_CK, and a sixth pointer $P_6$ as a next rising time point t3 of the reference signal RF_CK. Although next rising and falling time points of the clock can be defined, the reference signal RF_CK can be defined using only the three time points t1, t2 and t3 if the reference signal RF_CK has equally repeated waveforms. Accordingly, it is sufficient if the lookup table has at least three offset pointers that define the waveforms of the reference signal with respect to the active pulse width of the horizontal synchronization signal.

Referring to FIGS. 7 and 8, the EED device has the expression range of 320 gray levels, which is increased by 25% compared with the expression range of 256 gray levels.

Next, the active pulse widths of the horizontal synchronization signals are examined (S20).

In this embodiment, the examining of the active pulse widths of the horizontal synchronization signals includes a counting of the horizontal synchronization signals based on the system clock and a calculating of the active pulse width values. For example, the synchronization signal counter 11 counts the active pulse widths of the horizontal synchronization signals Hsync based on the system clock SYS_CK and outputs an n-bit data to the reference signal referring unit 13. The active pulse widths of the horizontal synchronization signals are pulse duration periods in which the horizontal synchronization signals are in an on state.

Next, the lookup table of the reference signal memory is referred according to the active pulse widths of the horizontal synchronization signals and the reference signals are outputted (S30). The outputting of the reference signals can be performed by the reference signal referring unit 13. The reference signal referring unit 13 selects the reference signals RF_CK for obtaining required modulation pulse widths with reference to the lookup table of the reference signal memory 12, depending on information about the active pulse widths of the horizontal synchronization signals, which are evaluated by the synchronization signal counter 11. When the lookup table stored in the reference signal memory 12 has the waveform data of the reference signals corresponding to the active pulse widths of the horizontal synchronization signals Hsync (that is, the waveform data such as the cycle or the pulse width), the reference signal referring unit 13 outputs the reference signal RF_CK in its own waveform. When the lookup table stored in the reference signal memory 12 has the offset pointers of the reference signals, the waveforms of the reference signals RF_CK based on the system clock SYS_CK are calculated and outputted as the reference signals RF_CK.

Next, the reference signals are counted and the gray level signals are outputted to the data driver 18 (S40). The reference signals RF_CK that are selectively outputted from the reference signal referring unit 13 are inputted to a gray level signal generator 14. The gray level signal generator 14 inputs the gray level signals GL to the data driver 18. Here, the gray level signals GL are obtained by counting the reference signal RF_CK. A modulation comparator 185 of the data driver 18 modulates the pulse widths of the video data using the gray level signals GL.

Finally, the video data signal and the gray level signal GL are compared at the data driver 18. If the video data signal coincides with the gray level signal GL, the PWM display data signal is outputted to the data electrode lines (S50). The video data of one horizontal line are sequentially stored in the shift register 181 of the data driver 18. The serial video data received from the shift register 181 are stored in the latch register 183 as the parallel video data. At the modulation comparator 185, the parallel video data of the latch register 183 are compared with the gray level signal GL of the reference signal referring unit 13. If the parallel video data coincides with the gray level signal GL, the parallel video data SC1, SC2 and SC3 are outputted as the PWM display data signals to the data electrode lines $C_{R1}$ to $C_{Bm}$.

According to the driving method of the present invention, the pulse widths of the data signal can be actively adjusted through the reference signals that are defined in advance within the lookup table according to the active pulse widths of the horizontal synchronization signals.

As described above, there is provided the EED device having the available expression range of the gray level and the driving method thereof Particularly, there are provided the EED device and the driving method thereof, which can actively adjust pulse widths of data signals using a predefined waveform or a predefined pointer according to the active pulse widths of the horizontal synchronization signals.

According to the present invention, the expression range of the gray level can be expanded by modifying the lookup table in which a waveform of the gray levels are defined depending on the active pulse widths of the horizontal synchronization signals. Also, when the active pulse widths of the horizontal synchronization signals are reduced, the reduction in the expression range of the gray levels and the luminance can be prevented by modifying the lookup table according to the waveforms of the gray level signals corresponding to the reduced active pulse widths.

While the present invention has been particularly shown and described with reference to exemplary embodiments thereof, it will be understood by those of ordinary skill in the art that various modification in form and detail can be made therein without departing from the spirit and scope of the present invention as defined by the following claims.

What is claimed is:

1. An Electron Emission Display (EED) device comprising:

a scan driver:

a data driver;

an EED panel adapted to display a display data signal according to a scan signal of the scan driver, the display data signal obtained by modulating a pulse width of video data from the data driver;

a reference signal memory adapted to store a lookup table of active pulse widths of horizontal synchronization signals defined by a system clock and reference signals corresponding to the active pulse widths of the horizontal synchronization signals, the lookup table being arranged to store values to expand an expression range of gray levels beyond a predetermined number of grayscale levels;

a reference signal referring unit adapted to output a reference signal in accordance with the lookup table stored in the reference signal memory;

a gray level signal generator adapted to count the reference signal and output a gray level signal to the data driver; and a synchronization signal counter adapted to examine the active pulse width of a horizontal synchronization signal;

wherein the data driver outputs the display data signal corresponding to the gray level signal and the video data to data electrode lines of the EED panel; and wherein the synchronization signal counter is adapted to count the horizontal synchronization signal based on the system clock and to output an active pulse width value of the horizontal synchronization signal to the reference signal referring unit.

2. The EED device of claim 1, wherein the reference signal memory includes a lookup table adapted to store waveform data of the reference signals corresponding to the active pulse widths of the horizontal synchronization signals.

3. The EED device of claim 2, wherein the lookup table is adapted to store waveform data of the reference signals whose 1-pulse cycles are adjusted to correspond to the active pulse widths of the horizontal synchronization signals.

4. The EED device of claim 3, wherein the 1-pulse cycles are multiples of a clock pulse width of the system clock.

5. The EED device of claim 2, wherein the lookup table is adapted to store waveform data of the reference signals whose pulse widths have been adjusted to correspond to the active pulse widths of the horizontal synchronization signals.

6. The EED device of claim 5, wherein the pulse widths represented by the waveform data of the reference signals are multiples of a pulse width of the system clock.

7. The EED deivce of claim 1, wherein the reference signal memory includes a lookup table adapted to store offset pointers of reference signals corresponding to the active pulse widths of the horizontal synchronization signals with respect to the system clock.

8. The EED device of claim 7, wherein the offset pointers of the reference signals represent rising and falling time points of the reference signals with respect to the system clock.

9. The EED device of claim 8, wherein the offset pointers are set at every multiple of a pulse width of the system clock.

10. The EED device of claim 1, wherein the data driver comprises:

a shift register adapted to sequentially store serial video data of one horizontal line;

a latch register adapted to convert the serial video data into parallel video data; and a modulation comparator adapted to compare the parallel video data of the latch register with the gray level signal of the gray level signal generator and to output the Pulse Width Modulation (PWM) display data signal to data electrode lines upon the parallel video data coinciding with the gray level signal.

11. A method of driving an Electron Emission Display (EED) which displays a display data signal on an EED panel according to scan signal of a scan driver, the display data signal being obtained by modulating a pulse width of a video data at a data driver, the method comprising:

creating a lookup table of active pulse widths of horizontal synchronization signals and reference signals corresponding to the active pulse widths of the horizontal synchronization signals based on a system clock, the lookup table being arranged to store values to expand an expression range of gray levels beyond a predetermined number of grayscale levels;

examining an active pulse width of a horizontal synchronization signal;

generating a reference signal in accordance with the lookup table stored in a reference signal memory according to the active pulse width of the horizontal synchronization signal;

counting the reference signal to generate a gray level signal; and outputting the display data signal corresponding to a pulse width of the gray level signal and the video signal to data electrode lines of the EED panel;

wherein examining of the active pulse width of the horizontal synchronization signal includes counting the horizontal synchronization signal, based on the system clock, to calculate an active pulse width value.

12. The method of 11, wherein creating of the lookup table comprises storing waveform data of reference signals corresponding to the active pulse widths of the horizontal synchronization signals in the lookup table according to the system clock.

13. The method of claim 11, wherein creating of the lookup table comprises storing offset pointers of reference signals corresponding to the active pulse widths of the horizontal synchronization signals in the lookup table with respect to rising and falling time points of the reference signals according to the system clock.

14. The method of claim 11, wherein outputting the display data signal comprises:

sequentially storing serial video data of one horizontal line in a shift register;

storing the serial video image data received from the shift register as parallel video data in a latch register;

comparing the parallel, video data of the latch register and the gray level signal; and outputting the Pulse Width Modulated (PWM) display data signal to data electrode lines upon the parallel video data coinciding with the gray level signal.

* * * * *